United States Patent [19]

Hughes

[11] Patent Number: 4,592,420

[45] Date of Patent: Jun. 3, 1986

[54] REINFORCED PLATE FIN HEAT EXCHANGER

[75] Inventor: Gregory G. Hughes, Milwaukee, Wis.

[73] Assignee: Modine Manufacturing Company, Racine, Wis.

[21] Appl. No.: 749,282

[22] Filed: Jun. 27, 1985

[51] Int. Cl.[4] ..... F28F 1/32

[52] U.S. Cl. ..... 165/151; 165/906

[58] Field of Search ..... 165/151, 152, 153, 906

[56] References Cited

U.S. PATENT DOCUMENTS 3,437,134 8/1969 Oddy ..... 165/151

4,449,581 5/1984 Blystone et al. ..... 165/151

4,469,167 9/1984 Itoh et al. ..... 165/151

*Primary Examiner*—Sheldon J. Richter

*Attorney, Agent, or Firm*—Wood, Dalton, Phillips, Mason & Rowe

[57] ABSTRACT

A plate fin heat exchanger including generally parallel rows of flattened tubes extending through a stack of generally parallel plate fins. Each of the plate fins is provided with generally H-shaped deformations with the H-shaped deformations being in rows which are staggered with respect to each other. The deformations increase the rigidity of the plate fins during tube pushing and act to induce turbulence in a fluid flowing through the heat exchanger to enhance heat transfer.

9 Claims, 4 Drawing Figures

REINFORCED PLATE FIN HEAT EXCHANGER

FIELD OF THE INVENTION

This invention relates to a plate fin heat exchanger, and more particularly, to a reinforced plate fin utilized in such heat exchangers.

BACKGROUND OF THE INVENTION

Prior art of possible relevance includes U.S. Pat. Nos. 1,927,325 issued Sept. 19, 1933 to Ritter; 3,437,134 issued Apr. 8, 1969 to Oddy; and 4,449,581 issued May 22, 1984 to Blystone et al; and Australian Patent Specification No. 236,342 accepted Nov. 7, 1961. So-called plate fin heat exchangers have been used with considerable success in various heat exchange operations requiring the exchange of heat between a liquid and a gas or a gas and a gas. In the usual case, a plurality of relatively thin plates are disposed in slightly spaced, parallel relationship to form a stack of such plates which serve as fins. A plurality of tubes, in one or more rows, pass through aligned holes in each of the plate fins at generally right angles to the plane defined by each and by means of manifolds or the like are placed in fluid communication with each other to permit the circulation of a fluid, usually a liquid, through the resulting heat exchanger core.

In order to assure maximum heat transfer in such a core, it is necessary that the fins make good heat exchange contact with the tubes; and this is typically accomplished by making the relevant exterior dimensions of the tubes a few thousandths of an inch larger than the tube holes or openings in the plates. Thus, when the tubes are inserted in the holes, a snug fit with good contact results to maximize heat transfer through the junction.

This same snug fit can present difficulties in the assembly operation. For one, it means that the tubes must be forced through the holes, a process commonly referred to as "tube pushing". If the forces required to perform the tube pushing operation exceed the strength of the fins, the fins will bend which, at the very least, will result in a core having a poor appearance which may be perceived as shoddy workmanship. At worst, the bending may become so severe that the core cannot be successfully assembled in its entirety and will have to be scrapped.

To avoid these difficulties, it is heretofore been common to form the fins of plate stock that is thicker than is required for optimum heat transfer performance simply to attain the degree of structural integrity necessary to resist bending during the tube pushing operation. This, of course, not only adds to the material expense of the core, but will increase the weight of the same. In some applications, as, for example, vehicular applications, the excess weight is undesirable in that it will increase the energy costs for operating the vehicle.

The problem becomes particularly acute where the tubes are in multiple rows and as a consequence, the pushing of the fins in the central rows tend to cause the plate fins to bend or bow.

The problem is also acute in constructions where the tube in the multiple rows are aligned, so-called flat or oval tubes the presence of the tube holes of the aligned tubes in the direction of elongation of the flattened tubes frequently will result in the removal of in excess of 50% of the fin material at the location of alignment.

Consequently, the fins are very prone to bending at such location.

The present invention is directed to overcoming one or more of the above problems.

SUMMARY OF THE INVENTION

It is the principal object of the invention to provide a new and improved plate fin heat exchanger. More specifically, it is an object of the invention to provide a plate fin heat exchanger with fin stiffening beads which result in an easier tube pushing operation which in turn results in improved core appearance and a reduction in the number of cores scrapped due to tube pushing failures. Also the invention reduces bending distortion during fin handling and core assembly. In addition, the invention allows deeper cores to be built with relatively thinner fin stock. The invention also contemplates that the fin stiffeners induce turbulent flow of a gas through the fins to reduce boundry layer flow to thereby increase heat transfer performance.

An exemplary embodiment of the invention achieves the foregoing objects in a plate fin heat exchanger including a plurality of generally parallel rows of flattened tubes, each row having a plurality of the tubes in alignment with each other. There is provided a stack made up of a plurality of plate fins in generally parallel relation. Each of the plate fins has tube holes shaped to receive the tubes in the rows and in their alignment with the tubes being disposed in the holes and extending through the stack. Deformations are disposed in each of the plate fins and the deformations include pairs of first ridges which flank aligned tubes in at least two adjacent rows and second ridges between the rows extending substantially between two of the first ridges.

In a plate fin heat exchanger made according to the foregoing, the first ridges act to strengthen the fins against bowing during tube pushing while the second ridges rigidify the fin to prevent bending along a line defined by aligned ones of the tube holes during fin handling between fin production and core assembly.

According to a preferred embodiment, the tubes are flattened tubes and are elongated generally transversely to the length of the rows.

In a highly preferred embodiment, the ends of the second ridges are joined to the first ridges intermediate the ends of the first ridges.

The invention further contemplates that provision of additional deformation in each of the plate fins and disposed between each of the tubes in each of the rows. In one embodiment, the additional deformations are in the form of dimples.

In a highly preferred embodiment, one ridge of each two pairs of first ridges and the associated second ridge define an H-shaped deformation and there is a set of such H-shaped deformations for each of the rows of tubes. The H-shaped deformations in one row are staggered with respect to the H-shaped deformations in the adjacent rows.

Other objects and advantages will become apparent from the following specification taken in connection with the accompanying drawings.

DESCRIPTION OF THE PREFERRED EMBODIMENT

Figure 1:
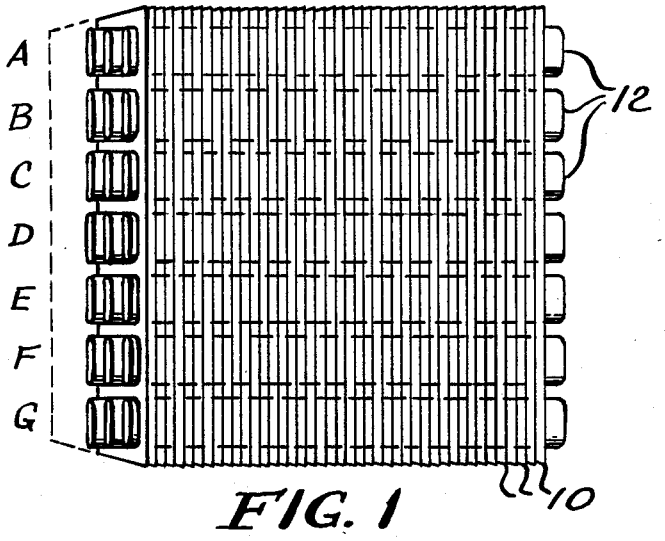
FIG. 1 is a view of a heat exchanger core made according to the invention.

An exemplary embodiment of a plate fin heat exchanger made according to the invention is illustrated in the drawings and with reference to FIG. 1 is seen to include a plurality of thin plate fins 10 made of thermally conductive material disposed in generally parallel relation to form a stack. Extending through the stack are a plurality of tubes 12. As can be seen, from top to bottom, there are seven rows A, B, C, D, E, F and G of tubes 12, each row shown as containing three aligned tubes. In the usual case, a greater number of tubes 12 will be disposed in each row. It should also be observed that the number of rows may be increased or decreased depending upon the intended application to which the heat exchanger is to be put.

Figure 2:
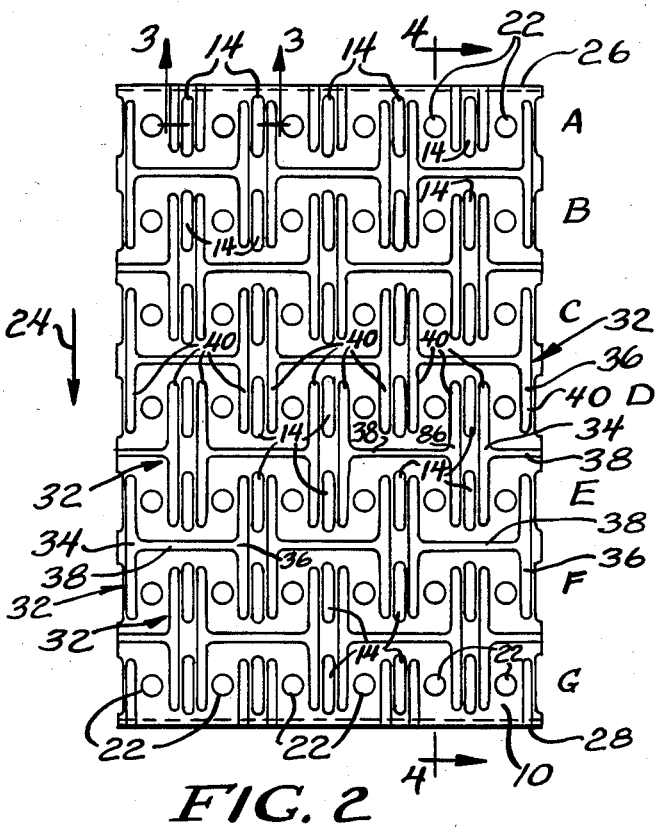
FIG. 2 is a fragmentary, plan view of a fin plate embodying the invention.
Figure 3:
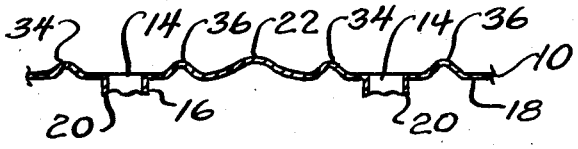
FIG. 3 is an enlarged, fragmentary view taken approximately along the line 3—3 in FIG. 2.

FIG. 2 illustrates a representative one of the plate fins 10, it being understood that they all will be generally identical. In FIG. 2, the tubes 12 are not shown as extending through the plate 10. Rather, open tube holes 14 through which the tubes 12 extend are shown. As illustrated in FIG. 2, the tube holes 14 are elongated and of oval configuration to receive tubes 12 of the so-called flattened or oval type. As seen in FIG. 3, each of the tube holes 14, about its periphery, includes a neck or collar 16 which projects from one side 18 of the plate 10. The necks 16 serve to provide a good zone of engagement between each tube 12 and the plates 10 to facilitate good heat transfer.

Between each tube hole 14 in a given one of the rows A–G, inclusive, is a deformation in the form of a dimple 22. The dimples 22 are formed in the plate fin 10 as by stamping and serve to promote turbulence in a fluid flowing through the space between adjacent plate fins 10. In this respect, the usual direction of air flow through the core is shown by an arrow 24 in FIG. 2. It is to be observed, however, that if desired, the dimples 22 could be replaced by other sorts of deformations as, for example, louvers (not shown).

Figure 4:
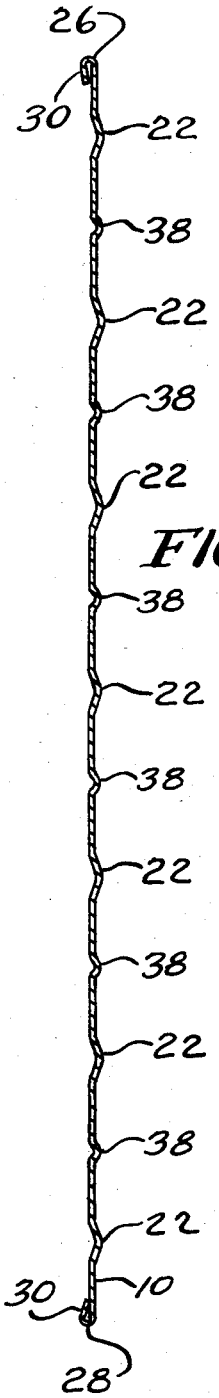
FIG. 4 is an enlarged, fragmentary sectional view taken approximately along the line 4—4 in FIG. 2.

As seen in FIGS. 2 and 4, opposite edges 26 and 28 of each plate fin 10 are provided with reversed folds 30 for strengthening purposes in these areas.

Finally, each plate fin 10 is provided with a series of generally H-shaped deformations, each designated 32. As seen in FIG. 2, the H-shaped deformations 32 are in a plurality of sets, there being essentially one set of H-shaped deformations 32 for each of the tube rows A–G inclusive. Each H-shaped deformation is formed of beads or ridges which may be stamped into the plate fin 10 so as to project in the same direction as the dimples 22 and generally oppositely of the necks 16 as can be seen in FIG. 3.

More specifically, each H-shaped deformation 32 is formed of two spaced first ridges 34 and 36 which correspond to the uprights of the "H". In addition, each H-shaped deformation 32 includes a second ridge 38 which correspond to the cross member or center of the "H". Each ridge 34, 36 and 38 is generally straight lined and it will be seen that the ends of the center or second ridges 38 are joined with the first ridges or uprights 34 and 36 intermediate their ends. In short, in the embodiment illustrated, there is continuity of the ridges. However, it is to be understood that in some instances, it may be desirable to terminate the ends of the second ridges 38 short of the ridges 34 and 36 to form what might be termed a broken or stencilled "H" design.

It will be seen that the ridge 36 of one H-shaped deformation 32 and the ridge 34 in the adjacent H-shaped deformation 32 closely flank aligned ones of the tube holes 14 in two adjacent rows. It will also be seen that the second ridges 38 are located between the rows A–G of tube holes 14 and extend generally parallel to such rows. Further, the first ridges 34 and 36 of any given H-shaped deformation 32 are of sufficient length so that two of the tube holes 14 are confronted, and each adjacent H-shaped deformation 32 is separated by one tube hole 14 in the same row. It can further be appreciated from FIG. 2 that the H-shaped deformations 32 in eact set or row are staggered with respect to each other to provide an interleaved pattern of H-shaped deformations 32.

As alluded earlier, the removal of material from the fin 10 to form the tube holes 14, particularly where the tube holes 14 are elongated, creates a line essentially extending between the edges 26 and 28 and aligned with the center of aligned ones of the tube holes 14 that is quite weak upon which, during a fin handling or tube pushing operation, the fin could buckle or bend. Resistance to such bending is, however, provided by the presence of the second ridges 38. In the embodiment illustrated, for each such zone of weakness caused by the formation of the tube holes 14, there are at least three of the ridges 38 extending across the same to resist bending thereat.

At the same time, bowing of the plate fins 10 during a tube pushing operation is resisted by the presence of the first ridges 34 and 36 which closely flank, on both sides, the tube holes 14 in the direction of their elongation. Consequently, for example, when tubes are pushed in the tube row D, bowing is resisted by those portions of the ridges 34 and 36 designated 40 in FIG. 2.

Because the plate fins 10 are rigidified by the ridges 34, 36 and 38 in the previously described pattern, tube pushing is made easier. In particular, there is less deformation of the plate fins 10 which would cause the edges of the tube holes 14 to cant and grip the tubes 12 as they are being inserted. This in turn means less force need be applied to the tubes 12 during tube pushing which in turn means lesser force is applied to the plate fins 10 during tube pushing. As an overall consequence of the application of lesser force to the plate fins 10, there is less apt to occur, undesirable bowing or bending which could adversely affect the appearance of the resulting core or damage the same to the point where it would have to be scrapped.

Furthermore, because tube pushing is made easier and with less force application to the plate fins 10, the plate fins 10 may be made of a thinner material thereby providing a material savings as well as a weight reduction. Additionally, easier tube pushing also allows deeper cores to be formed, that is, cores with a greater number of rows of the tubes 12.

Finally, in addition to the turbulent flow induced by the dimples 22, the H-shaped deformations 32 also serve to induce turbulent flow to reduce boundry layer flow characteristics and thereby improve heat transfer in the core.

While the invention has been described in connection with a multiple tube row heat exchanger wherein the corresponding tubes in the various rows are all aligned on a straight line basis, the invention is also applicable to so-called staggered tube design. In such a case, a staggered configuration of tube holes 14, wherein the tube holes 14 in adjacent rows are staggered with respect to each other is selected.

I claim:

1. A plate fin heat exchanger comprising:

a plurality of generally parallel rows of tubes, each row having a plurality of said tubes in alignment with each other;

a stack comprised of a plurality of plate fins in generally parallel relation, each having tube holes shaped to receive said tubes in said row and said alignment, said tubes being disposed in said holes and extending through said stack; and deformations in each of said plate fins, said deformation including pairs of first ridges flanking aligned tubes in at least two adjacent rows, and second ridges between said rows extending substantially between two of said first ridges.

2. The plate fin heat exchanger of claim 1 wherein said tubes are flattened tubes and are elongated generally transversely to the length of said rows.

3. The plate fin heat exchanger of claim 1 wherein the ends of said second ridges are joined to said first ridges intermediate the ends of said first ridges.

4. The plate fin heat exchanger of claim 3 wherein each of said tube holes includes a neck extending in one direction from the associated plate fin.

5. A plate fin heat exchanger comprising:

a plurality of generally parallel rows of flattened tubes, each row having a plurality of said tubes in alignment with each other;

a stack comprised of a plurality of plate fins in generally parallel relation, each having tube holes shaped to receive said tubes in said row and said alignment, said tubes being disposed in said holes and extending through said stack; and a plurality of generally H-shaped deformations in each of said fins, each deformation being comprised of two, generally parallel uprights and a generally transverse cross member disposed between said uprights intermediate their ends, said deformation being disposed in rows such that there is generally one row of deformations for each row of tubes, the uprights of two adjacent rows with the deformation in adjacent rows being staggered with respect to each other.

6. The plate fin heat exchanger of claim 5 wherein said cross members extend to and join with the associated uprights.

7. The plate fin heat exchanger of claim 5 further including a plurality of additional deformations in each said fin, there being an additional deformation disposed between each of the tubes in each of the rows.

8. The plate fin heat exchanger of claim 7 wherein said additional deformations are dimples.

9. A plate fin heat exchanger comprising:

a plurality of generally parallel rows of flattened tubes, each row having a plurality of said tubes in alignment with each other;

a stack comprised of a plurality of plate fins in generally parallel relation, each having tube holes shaped to receive said tubes in said row and said alignment, said tubes being disposed in said holes and extending through said stack;

a plurality of generally H-shaped ridges in each of said plate fins, each said ridge having its opposed sides closely flanking every second tube hole in two adjacent rows of said tubes and its center extending between said sides between said two adjacent rows; there being a set of said ridges for each of said rows, with the ridges of each set for adjacent rows being staggered to define interleaved H-shaped patterns;

a plurality of deformations in said plate fins, there being a deformation disposed between adjacent tube holes in each of said rows.

* * * * *